US005518576A

United States Patent [19]

Mendelovich et al.

[11] Patent Number: 5,518,576

[45] Date of Patent: May 21, 1996

[54] APPLICATOR

[75] Inventors: Isaac Mendelovich, Elkins Park; Peter W. Bressler; John D. Coleman, both of Philadelphia, all of Pa.

[73] Assignee: Tapelicator, Inc., Philadelphia, Pa.

[21] Appl. No.: 324,552

[22] Filed: Oct. 18, 1994

[51] Int. Cl.[6] ..... B32B 31/00

[52] U.S. Cl. ..... 156/523; 156/577; 156/579; 156/530

[58] Field of Search ..... 156/523, 526, 156/530, 540, 574, 577, 579

[56] References Cited

U.S. PATENT DOCUMENTS

| | | | |
|---|---|---|---|
| 496,607 | 2/1892 | Stevenson . | |
| 2,511,857 | 6/1950 | Fritzinger . | |
| 2,676,765 | 4/1954 | Kaplan . | |
| 2,868,402 | 1/1959 | Perry . | |
| 3,125,263 | 3/1964 | Harbour . | |
| 3,306,806 | 2/1967 | Seropian . | |
| 3,329,326 | 7/1967 | Simon . | |
| 3,523,053 | 8/1970 | Zbinden et al. . | |
| 3,725,182 | 4/1973 | Regan . | |
| 3,745,086 | 7/1973 | Parker . | |
| 4,238,271 | 12/1980 | Urushizaki | 156/523 |
| 4,344,813 | 8/1982 | Holoff et al. . | |
| 4,345,966 | 8/1982 | Iiyama et al. . | |
| 4,511,427 | 4/1985 | Karliner et al. | 156/523 |
| 4,591,407 | 5/1986 | Samuelson . | |
| 4,704,185 | 11/1987 | Fischer . | |
| 4,792,375 | 12/1988 | Lin | 156/530 X |
| 4,804,437 | 2/1989 | Tirtoprodjo et al. | 156/579 X |
| 5,073,228 | 12/1991 | Lin . | |
| 5,076,883 | 12/1991 | Bosley | 156/523 X |

OTHER PUBLICATIONS

D. L. Pierson, "Label Attachment Machine", IBM Technical Disclosure Bulletin 2257, vol. 18, No. 7, Dec. 1975.

*Primary Examiner*—James Engel

*Attorney, Agent, or Firm*—Panitch Schwarze Jacobs & Nadel

[57] ABSTRACT

An applicator for dispensing tape is disclosed. The applicator comprises a shell and a cover that is used as a knob for moving an instrument of a cutting tool for cutting the tape. In operation, the cover is rotated and moved in a counterclockwise direction to cause one of its ends to find its way into a passageway allowing it to contact a lever member which, in turn, contacts an arm member of the cutting tool thereby causing the adhesive tape to be severed thereat. The applicator is shaped, contoured, and sized so as to be manipulated by a single hand of a user and the cover member is mechanized so that the applicator only exposes the tape to the outside environment during the usage of the tape and, thereby, retards the tape from being subjected to contaminants.

12 Claims, 10 Drawing Sheets

APPLICATOR

FIELD OF THE INVENTION

This invention relates to an applicator for various materials such as dispensing tape, and more particularly, to an applicator shaped and sized to be conveniently used by a single hand of a user and only exposing tape when it is to be dispensed to selected portions of surfaces, such as printed lines of text material, which are preferably identified without leaving permanent markings thereon.

BACKGROUND OF THE INVENTION

In today's academia, the price of school books is not inconsequential. Typically, students purchase the books and then use highlighters to indicate the subject matter of the book which is important to their course of study. Unfortunately, this method for highlighting the important subject matter is problematic because it permanently scars or defaces the book and prevents the book from readily being resold to subsequent students for reuse. Hence, there exists a need for allowing a student to easily mark a book without permanently scaring the book to allow the student to resell the book as though it was nearly new.

The need to avoid permanently defacing a document is not limited to academia, but also is applicable to the home and office because highlighters are commonly used to permanently mark items or documents. The permanent marking of documents is sometimes avoided by the use of applicators that place a removable label on the document itself. Furthermore, in office applications, a correction or cover tape may be used to cover up indicia placed on the exterior of a container so as to allow that container to be reused for storage of other documents or on documents that need to be redated prior to copying.

An applicator that dispenses tape to serve as a highlighting function, yet to be removably applied to a surface so as not to destroy the printed page, is described in U.S. Pat. No. 5,076,883 of Bosley. The dispenser of Bosley has a tubular shape which may have some drawbacks with regard to its maneuverability, especially when compared with the shape of a contoured instrument, such as an easily grippable and maneuverable writing instrument having a contoured shape. The difficulty of manipulating a tubular device may be particularly experienced by children, older users or individuals with a handicap that impairs their motor control skills. In addition, to its disadvantage with regard to its manipulation, the dispenser of Bosley leaves its tape exposed to the environment. Such exposure may allow contaminates to find their way onto the adhesive tape and, thereby, hinder the adhesion of the tape to the surface of interest.

The prior art indicated by the aforementioned reference describing an applicator seems to suffer from the drawbacks of not providing a closed environment when its tape is not being used so as to prevent any contaminates from finding their way thereon and also for not providing a contoured shape that is more amenable to that desired for a writing instrument so that the applicator may be easily manipulated by all of its users, even those suffering from motor skills deficiencies.

SUMMARY OF THE INVENTION

An applicator for dispensing adhesive tape that is contoured and sized so as to allow for easy manipulation, while at the same time only exposing the tape during its application onto a surface of interest is provided. The applicator has a control knob that manages its operation and is easily maneuvered so as to allow the manipulation of the applicator by the use of a single hand of a user. The control knob performs the function of exposing the tape for the application thereof to a surface and also controls the cutting of the applied tape. The applicator is easily assembled in a snap-lock manner so as to reduce its attendant manufacturing cost.

The applicator includes appropriate provisions so that its adhesive tape may be easily removed, and may be easily disassembled so as to conveniently accommodate the replacement of the adhesive tape.

The adhesive tape may have different colors, dimensions, and other various characteristics so as to serve the needs of the school, home and office. The tape may be opaque or transparent, depending upon the use to be made. Further, while tape is described herein, the applicator could be readily used for dispensing ribbon, string or similar material without departing from the spirit and scope of this invention.

The adhesive tape is normally in the form of a roll which is installed on a cartridge which, in turn, is inserted into the applicator in a snap-lock manner. The cartridge includes provisions for preventing the tape from recoiling back toward the roll after it is cut, and provisions which assist in the outward feeding of the tape so as to avoid the situation of the tape sticking to the surface of the cartridge.

The applicator also has provisions that allow for the tape to be applied to a surface in a relatively gentle but firm manner, so that the tape adheres to the applied surface but does so without crushing the surface, such as might otherwise occur during the wrapping of gifts contained in relatively fragile packages.

In one aspect, the applicator dispenses tape having a leading edge and an adhesive material on at least one of its faces. The applicator comprises a shell, a cartridge, a cover, a cutting tool, an actuator member and a contact member. The shell has opposite sides with the first and second ends and with each of the opposite sides having a first groove in an exterior portion located at the first end and a first pin in an interior portion also located at the first end. The first end also has first and second passageways, whereas the second end has releasable connection devices. The shell also has devices for mating with a lever member and devices for mating with an actuator member. Further, the shell has a floor with open slots dimensioned for receiving the cartridge. The cartridge has a device for rotatably supporting a roll on which the adhesive tape is wound and from which a leading edge of the tape extends outwardly therefrom. The cartridge has connection devices which are complementary to and mate with the releasable connection devices of the shell. The cartridge further has rails which are complementary to, mate with and are insertable into the open slots of the shell. The cover has a second pin on each opposite side that respectively ride in the first grooves of the shell and also a second groove on each opposite side that accepts and allows the respective first pin of the shell to ride therein. The cover has an open and a closed portion both defined by a partial cylindrical member. The open portion of the cover serves as a third passageway which is in correspondence with the first passageway. The cutting tool has a first portion with the leading edge serving as a cutting instrument. The first portion thereof is dimensioned so as to be movable within the first passageway. The cutting tool also has at least one arm serving as the lever member and which has a device for mating with the lever mating device of the shell. The actuator member has a neck portion dimensioned to be movable within the second passageway and has first and second portions laterally extending away from the neck in opposite directions. The first portion thereof has a device for mating with the actuator device of the shell and the second portion thereof rests on the lever arm of the cutting tool. The contact member has an upwardly raised portion having first and second faces, with the first face being arranged so as to be capable of coming into contact with the leading edge of the tape. The raised portion is positioned in the first passageway proximate to the cutting tool.

In other embodiments, the first passageway has a lip at its leading edge and which is used to establish a fixed position of the applicator involved with the cutting operation of the adhesive tape. Further, the first face of the contact member preferably comprises a resilient material. Moreover, the partial cylindrical member of the cover preferably has a central portion at one of its ends that is dimensioned to be insertable into the second passageway so that the cover member may be rotated in a particular direction, e.g., counterclockwise, and control the operation of the cutting tool in the cutting of the adhesive tape.

BRIEF DESCRIPTION OF THE DRAWINGS

The foregoing "Summary of the Invention" and the following detailed description of preferred embodiments will be understood when read in conjunction with the appended claims. Although preferred embodiments are shown in the drawings, it should be understood that the invention is not limited to the precise arrangements and instrumentalities shown in the drawings, which are all diagrammatic:

DETAILED DESCRIPTION OF PREFERRED EMBODIMENTS

Figure 1:
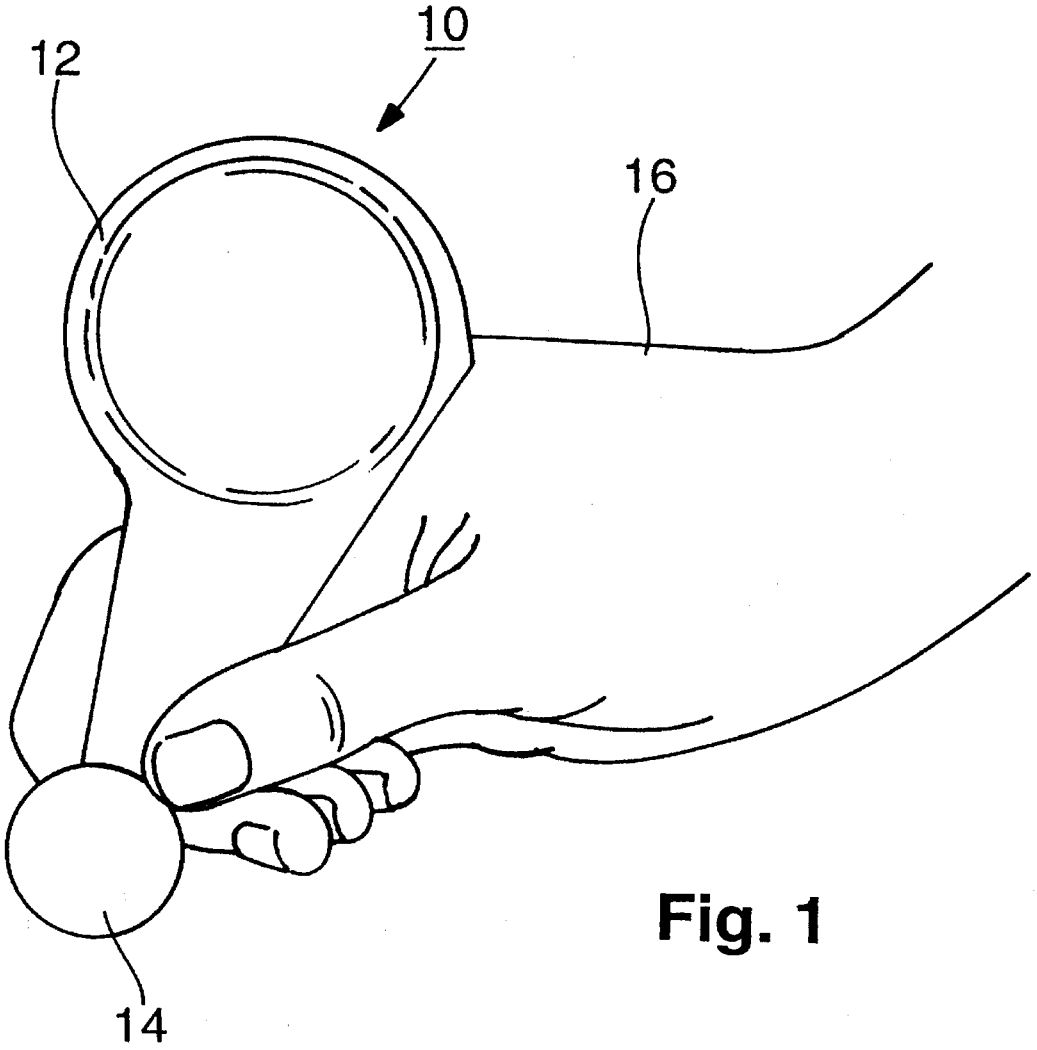
FIG. 1 is a perspective view illustrating the applicator of the present invention being held and used by a single hand of a user.

In the drawings, like numbers are employed for the indication of like elements.

Referring to the drawings, in particular to FIG. 1, there is shown an applicator 10 comprising a shell 12 and a cover member 14. The applicator 10 is advantageously shaped, sized and contoured so as to be easily manipulated by the use of a single hand 16 of a user and constructed so as to only expose its associated tape when the tape is to be applied to a surface of interest. Such limited exposure significantly reduces the amount of contaminants that might otherwise find their way onto the adhesive material of the tape and retard its sticking characteristic. The shell 12 and the cover 14, as well as other elements comprising applicator 10 to be further described, are preferably constructed of a polymeric material to facilitate manufacturing of the applicator 10 by means of a molding process. However, it is to be understood by those skilled in the art, that the elements 12 and 14, as well as other elements, could be constructed of other material, such as wood or metal without departing from the spirit and scope of the invention. These elements 12 and 14, in particular 12, are preferably further shaped, sized and contoured so as to form a conveniently grippable device that may be easily manipulated in a manner similar to a writing instrument, such as a fountain pen. More particularly, this shell 12 is preferably sized to fit within the single hand 16 of a user (as shown in FIG. 1), much like any writing instrument. Shell 12 has opposite sides which may be further described with reference to FIG. 2.

Figures 2A, 2B:
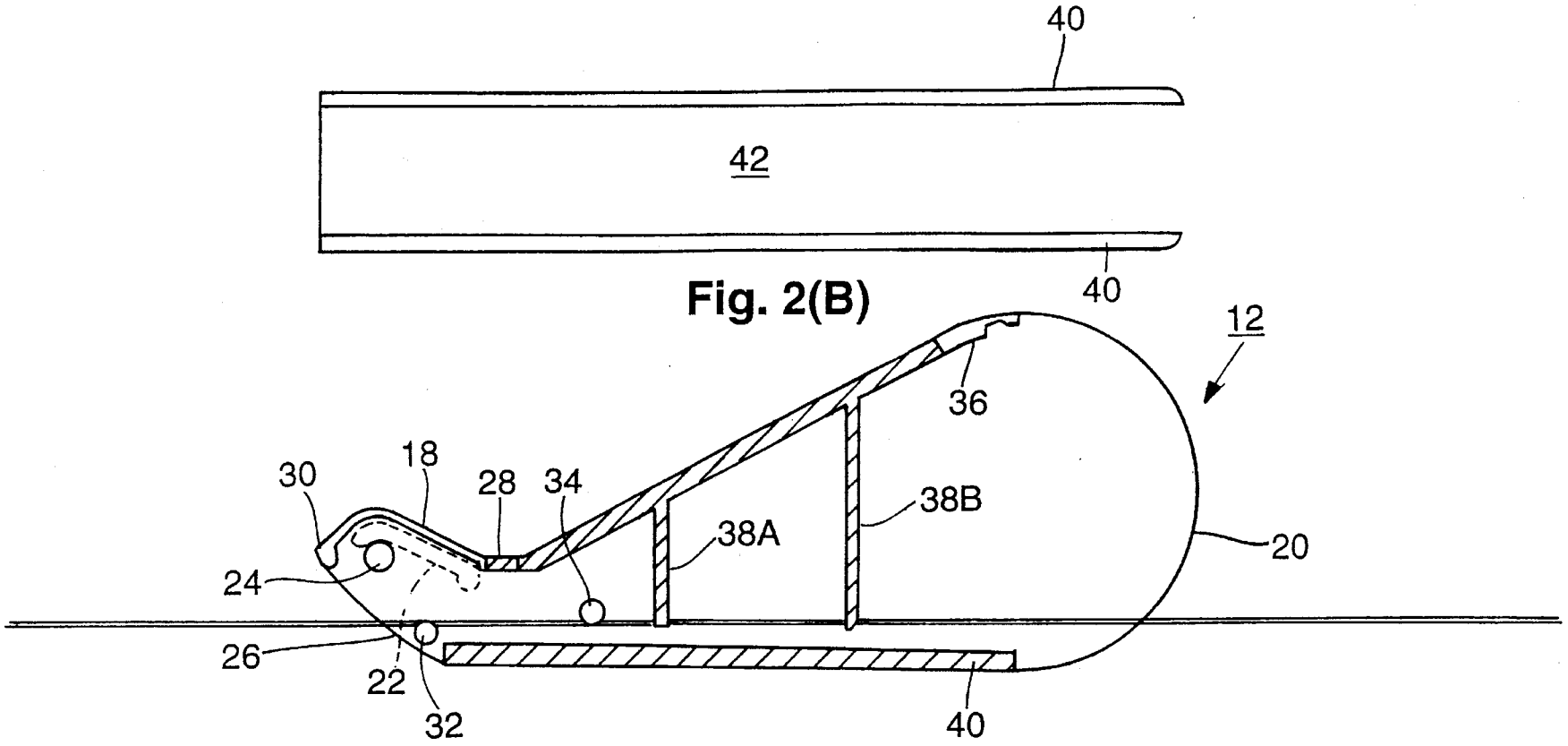
FIG. 2 is composed of FIGS. 2(A) and 2(B) that illustrate details of the shell of the applicator of the present invention.
Figure 5:
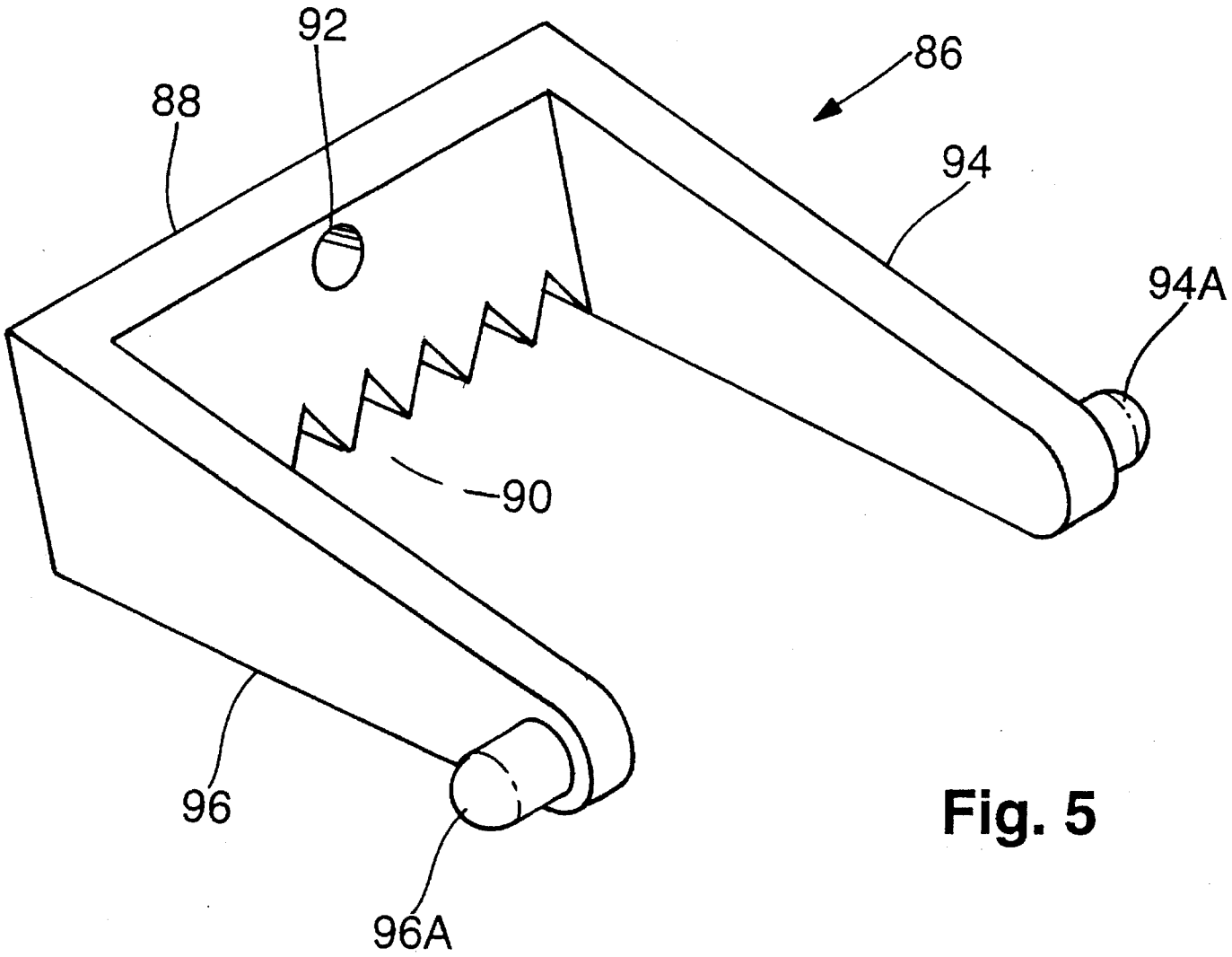
FIG. 5 illustrates the cutting tool of the applicator.
Figure 10:
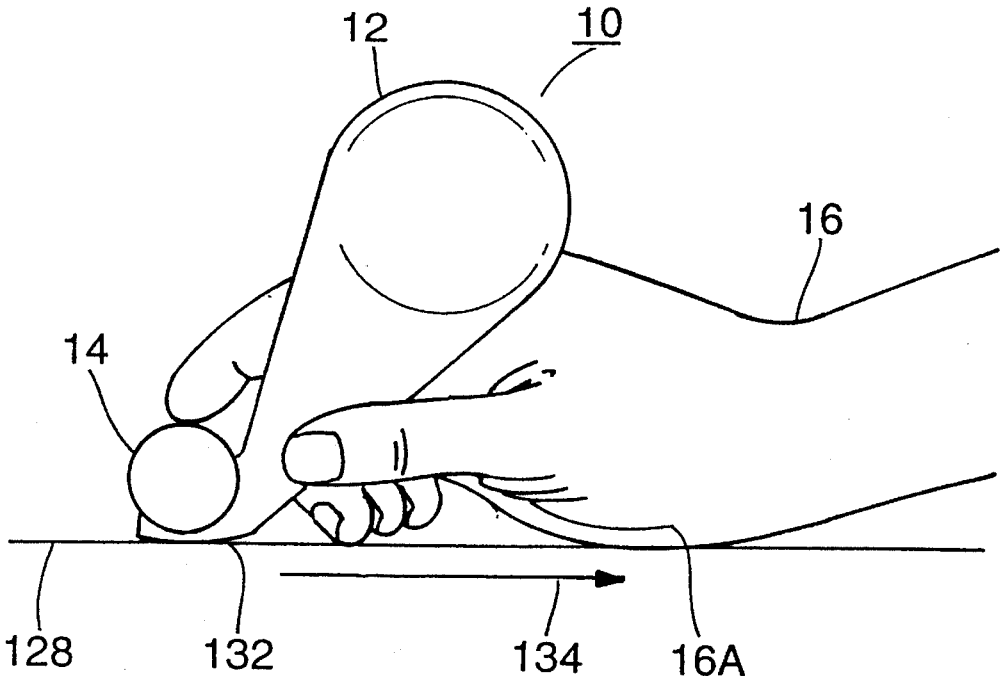
FIGS. 10 and 11 are perspective views showing the use of the applicator respectively applying and cutting the applied tape.
Figure 11:
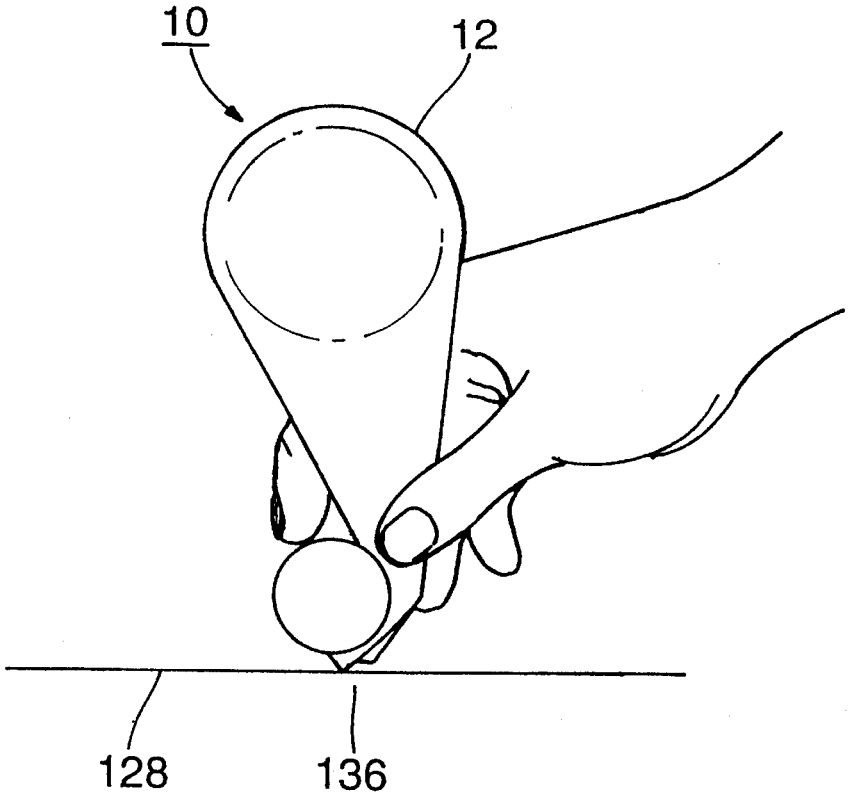

FIG. 2 is composed of FIGS. 2(A) and 2(B), wherein FIG. 2(A) illustrates, in section, one of the opposite sides of the shell 12. Although shell 12 is illustrated as comprising separate opposite sides, in actuality the sides are formed of a single member having an upper contoured portion to facilitate gripping thereof and which brings together or merges the opposite sides. Each of the sides of the shell 12 has first and second ends 18 and 20, respectively. The first end 18 has a first groove 22, shown in phantom, formed in its exterior portion and a first pin 24 affixed in its interior portion. The first end 18 has a first passageway 26 and a second passageway 28, with the first passageway 26 having a lip 30 at its leading edge which, as will be described with reference to FIGS. 10 and 11, is used to establish a stationary position for the applicator 10 prior to its cutting operation. The first end 18 has an opening 32 which serves as a device for mating with a lever member, to be described with reference to FIG. 5, and a second opening 34 which serves as a device for mating with an actuator member, to be described with reference to FIG. 7. The second end 20 has a connection device, which in one embodiment comprises a prong 36. The shell 12 may also comprise stiffening members 38A and 38B. The shell 12 has open slots 40 that form part of a floor 42, shown in FIG. 2(B). It should be noted that the floor 42 represents the lateral dimension of the applicator 10, when the opposite sides of the shell 12 of FIG. 2(A) are merged together. The shell 12 receives a cartridge 44, which may be further described with reference to FIG. 3.

Figures 3A, 3B:
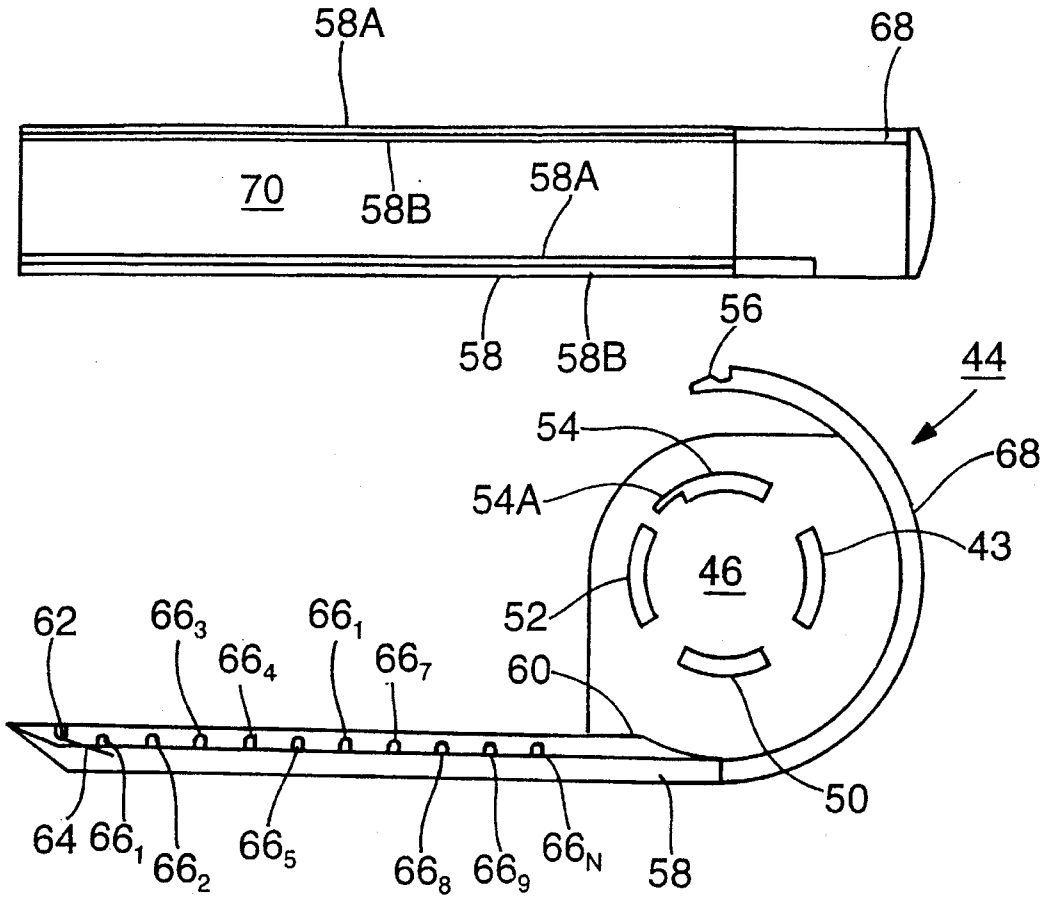
FIG. 3 is composed of FIGS. 3(A) and 3(B) which illustrate details of the cartridge of the applicator.

FIG. 3 is composed of FIGS. 3(A) and 3(B), wherein FIG. 3(A) illustrates, in section, one side of the cartridge 44. As seen in FIG. 3(A), the cartridge 44 has a device 46 for rotatably supporting a roll (not shown, but to be described with reference to FIG. 6) on which the tape, preferably of the adhesive type, is wound. The device 46 comprises partial rim members 48, 50, 52 and 54 that confine the lateral movement of the roll, and wherein the rim portion 54 has an extending member 54A that contacts and retards the ease of movement of the central region of the roll of tape. This retarding acts to prevent the tape from working its way off the roll, especially during transportation of the applicator, which might otherwise create slack in the tape that may undesirably find its way onto and stick to the interior portions of the cartridge 44. The cartridge 44 has a connection device, which for one embodiment, comprises a prong 56 that mates in a manner complementary with the respective prong 36 of the shell 12. The cartridge 44 further has a rail 58 and a tray 60 on which is mounted a plurality of bar members that laterally extend thereacross and one of which is bar member 62 located at the output stage of the cartridge 44 and has a member 64 connected to it which raises it above the other bar members $\mathbf{66}_1$, $\mathbf{66}_2$, $\mathbf{66}_3$, $\mathbf{66}_4$, $\mathbf{66}_5$, $\mathbf{66}_6$, $\mathbf{66}_7$, $\mathbf{66}_8$, $\mathbf{66}_9$ and $\mathbf{66}_N$. The bar members 62, $\mathbf{66}_1$, . . . $\mathbf{66}_N$ may have any shape but preferably have a cylindrical rod configuration. As will be further discussed hereinafter with reference to FIG. 11, the member 62 acts as means for preventing the tape, after being cut, from recoiling back toward its roll, whereas members $\mathbf{66}_1 \ldots \mathbf{66}_N$, because of their relatively small surface area, act as means for preventing the adhesive tape, which normally passes thereover, from being undesirably stuck to the inner surface of the cartridge. More particularly, even if the adhesive tape inadvertently and undesirably contacts any of the members $\mathbf{66}_1 \ldots \mathbf{66}_N$, the tape is easily released therefrom because of the relatively small surface area of these anti-stick members that contact the adhesive tape. As seen in FIG. 3(B), the rail members 58 are located on each side of the wall 70 of the cartridge 44 and have grooved out sections 58A and 58B which accommodate the insertion of the cartridge 44 into the shell 12. More particularly, the grooved sections 58A and 58B accommodate the insertion of the rails 58 into the open slots 40 of shell 12. The shell 12 also has attached thereto a cover 14 that may be further described with reference to FIG. 4.

Figure 4B:
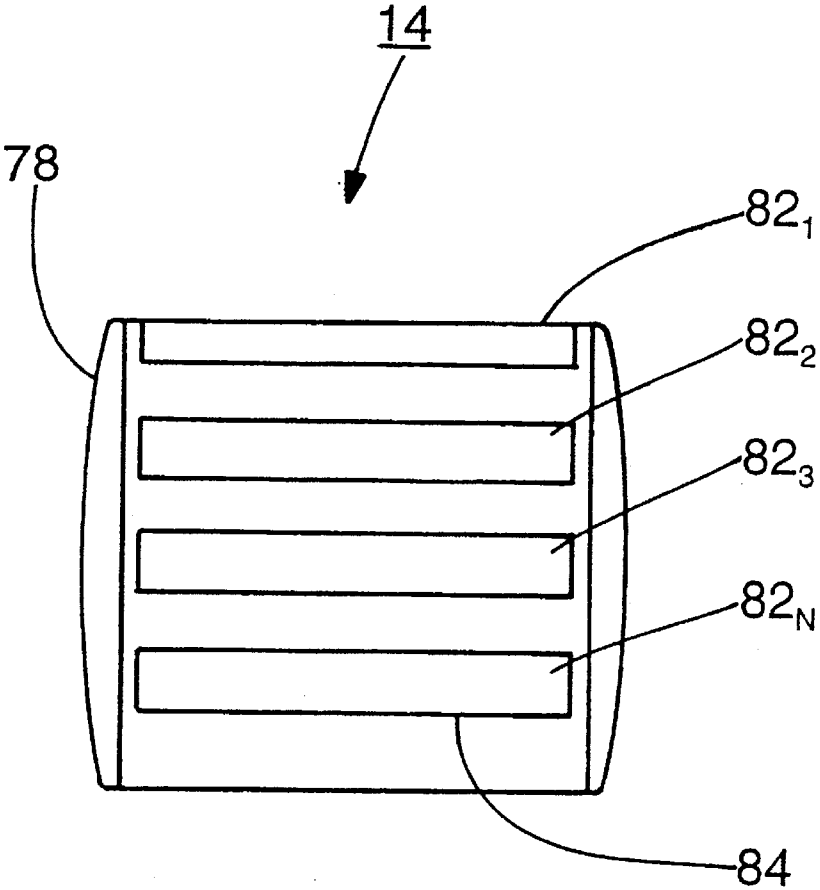
FIG. 4 is composed of FIGS. 4(A) and 4(B) that illustrate details of the cover of the applicator.
Figure 4A:
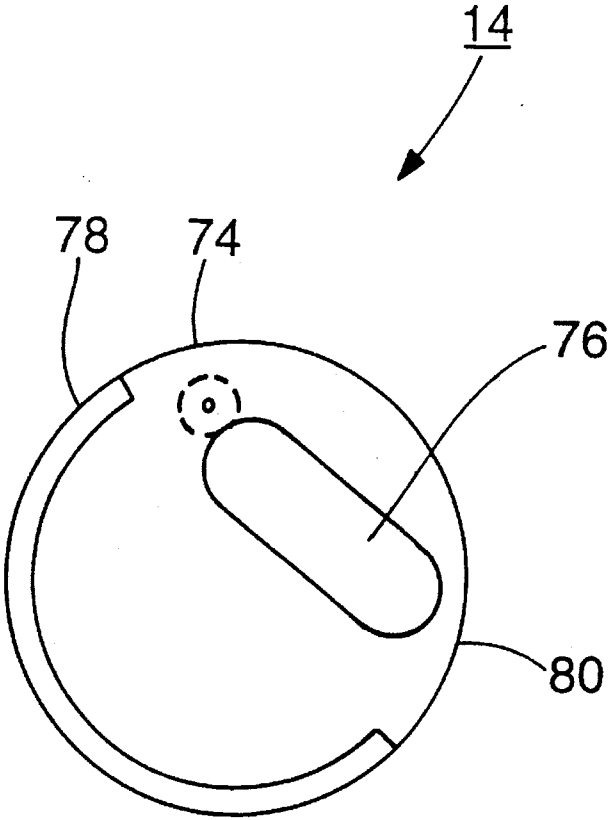

FIG. 4 is composed of FIGS. 4(A) and 4(B), and respectively illustrates a view of the interior of the cover 14 and a top view of a closed portion of the cover 14. As seen in FIG. 4(A), the cover 14 comprises a second pin 74 and a second groove 76. The pin 74 rides in the groove 22 of shell 12, whereas the groove 76 has the pin 24 of shell 12 riding therein. The pin 74 is located and lodged on its outer surface so as to mate with the exterior groove 22 of the shell 12, whereas the groove 76 is located on its inner surface so as to mate with the interior pin 24 of the shell 12. It should be understood that pin 74 and groove 76 of cover 14 are located on opposite sides of the cover 14 so as to cooperatively mate with groove 22 and pin 24 of shell 12. Further, as will be discussed with reference to FIGS. 7–9, these cooperatively acting pins and grooves are shaped and dimensioned so that the cover 14 may smoothly move with respect to the shell 12 in a predetermined path allowing the cover 14 to serve as a control knob for the applicator 10.

The cover 14 comprises a partial cylindrical member 78 that defines an open portion 80, serving as a third passageway, and a closed portion, not shown in FIG. 4(A) but to be described with reference to FIG. 7. As used herein, a partial cylindrical member is meant to represent a member similar to a partial barrel member having a partially closed side and corresponding top and bottom sections at opposite ends of the closed side. As seen in FIG. 4(B), the partial cylindrical member 78 has a plurality of members $\mathbf{82}_1, \mathbf{82}_2, \mathbf{82}_3 \ldots \mathbf{82}_N$, each protruding from its outer surface. Each of these protrusions $\mathbf{82}_1 \ldots \mathbf{82}_N$ allows the operator of applicator 10 to more easily grip and manipulate the cover 14, thereby, allowing the cover 14 to more easily serve as a control knob, as to be described. Further, the protrusion $\mathbf{82}_N$, preferably further comprises a non-skid surface 84 which allows the cover 14 to grip the surface to which the adhesive tape is being applied and to assist in the operation of the applicator 10, in a manner to be further described with reference to FIGS. 10 and 11. A cutting tool 86 which primarily assists in the cutting operation performed by the applicator 10 may be further described with reference to FIG. 5.

The cutting tool 86 has a first portion 88 with a leading edge 90 serving as a cutting instrument. The cutting instrument 90 preferably has a sawtooth base and may be comprised of either a plastic or a metal material. The first portion 88 further has an aperture 92 into which is insertable a spring member (not shown) to be described with reference to FIG. 7. The cutting tool 86 has at least one arm but preferably two 94 and 96, both of which serve as lever members and, in one embodiment, have prongs 94A and 96A, respectively, that mate with the lever mating device 32 of the shell 12. In one embodiment, the lever members 94 and 96 may have a thickness of about 0.060 inches, while in another embodiment, this thickness may be increased to about 0.120 inches, which increase provides more surface area to come into contact with the surface to which the tape is being applied which, in turn, spreads the force being applied thereto, so as to act against any scarring thereof. The cutting tool 86 cuts the tape 98 which may be further described with reference to FIG. 6.

Figures 6A, 6B:
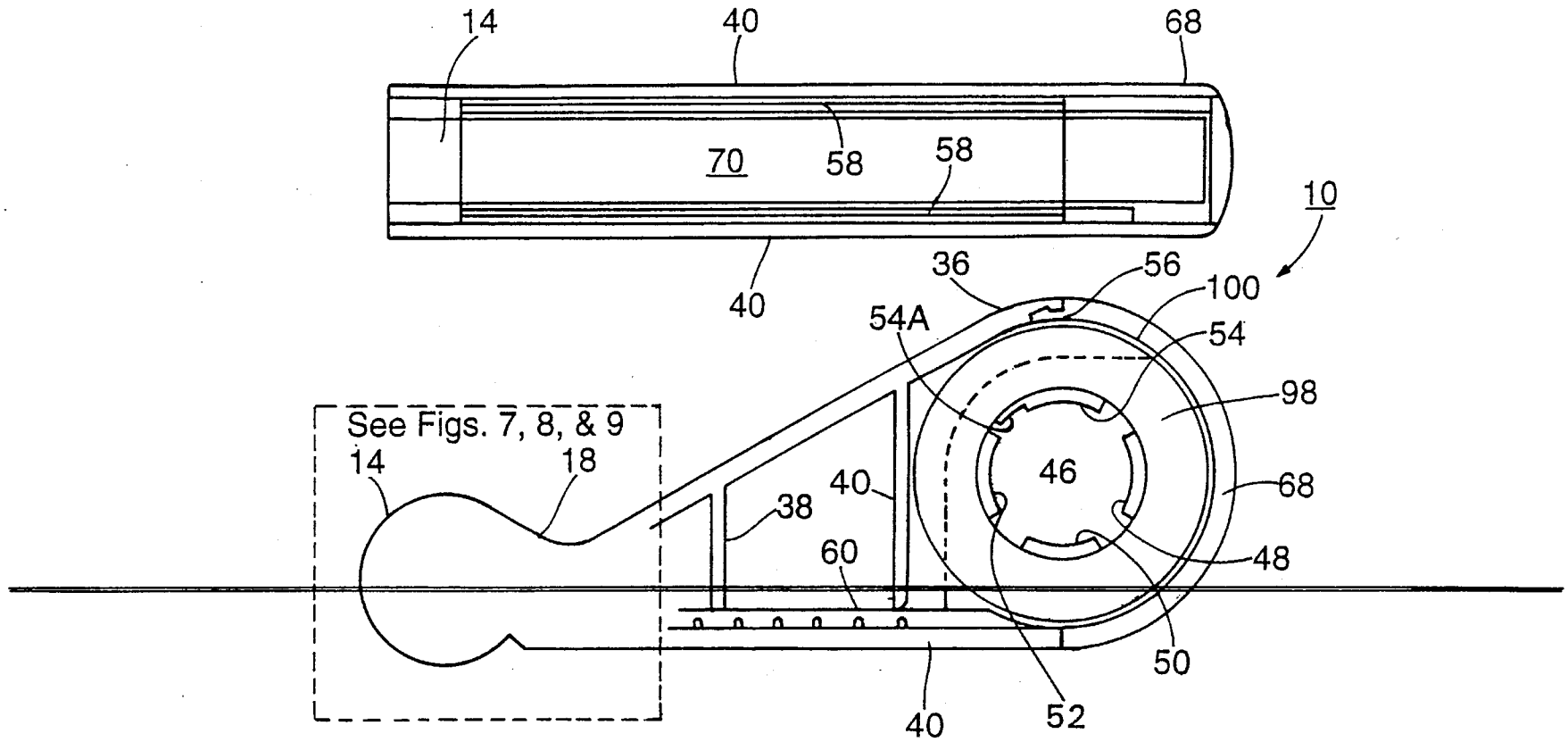
FIG. 6 is composed of FIGS. 6(A) and 6(B) which partially illustrate the assembled applicator of the present invention.

FIG. 6 partially illustrates an assembled applicator 10 and is composed of FIGS. 6(A) and 6(B), wherein FIG. 6(A) illustrates the tape 98 as being wound onto a roll 100 that is placed onto rotatable mounting device 46. The roll 100 and adhesive tape 98 may have various width dimensions varying from 1/16 of an inch to about two inches, and may comprise various colors such as yellow, green or orange, and may be used to accommodate marking, highlighting, labelling and other types of applications commonly provided by an adhesive dispenser. Further, the tape may be opaque or transparent, depending upon the use to be made. Further, while tape is described herein, the applicator 10 could be readily used for dispensing ribbon, string or similar material without departing from the spirit and scope of this invention. Further still, the tape 98 may be used for correction purposes for the covering up of a transparent or non-transparent material, or may be of a relatively heavy-gauge material commonly used for packing. The tape 98, arranged within the applicator 10 of the present invention, may find usage in the office, or in school and may be conveniently used by children, adults, as well as those users having motor skill impediments.

As further seen in FIG. 6(A), the prong 56 of the cartridge 44 mates with the prongs 36 of the shell 12. Further, the tray 60 of the cartridge 44 is insertable under the strengthening ribs 38A and 38B of the shell 12. As seen in FIG. 6(B), the rails 58 are inserted into the slots 40 of the shell 12. As seen in FIGS. 6(A) and 6(B), the cover 14 is located at the end 18 of the shell 12 and the cover 14, as well as other elements of the applicator 10, may be fully described with reference to FIG. 7.

Figure 7:
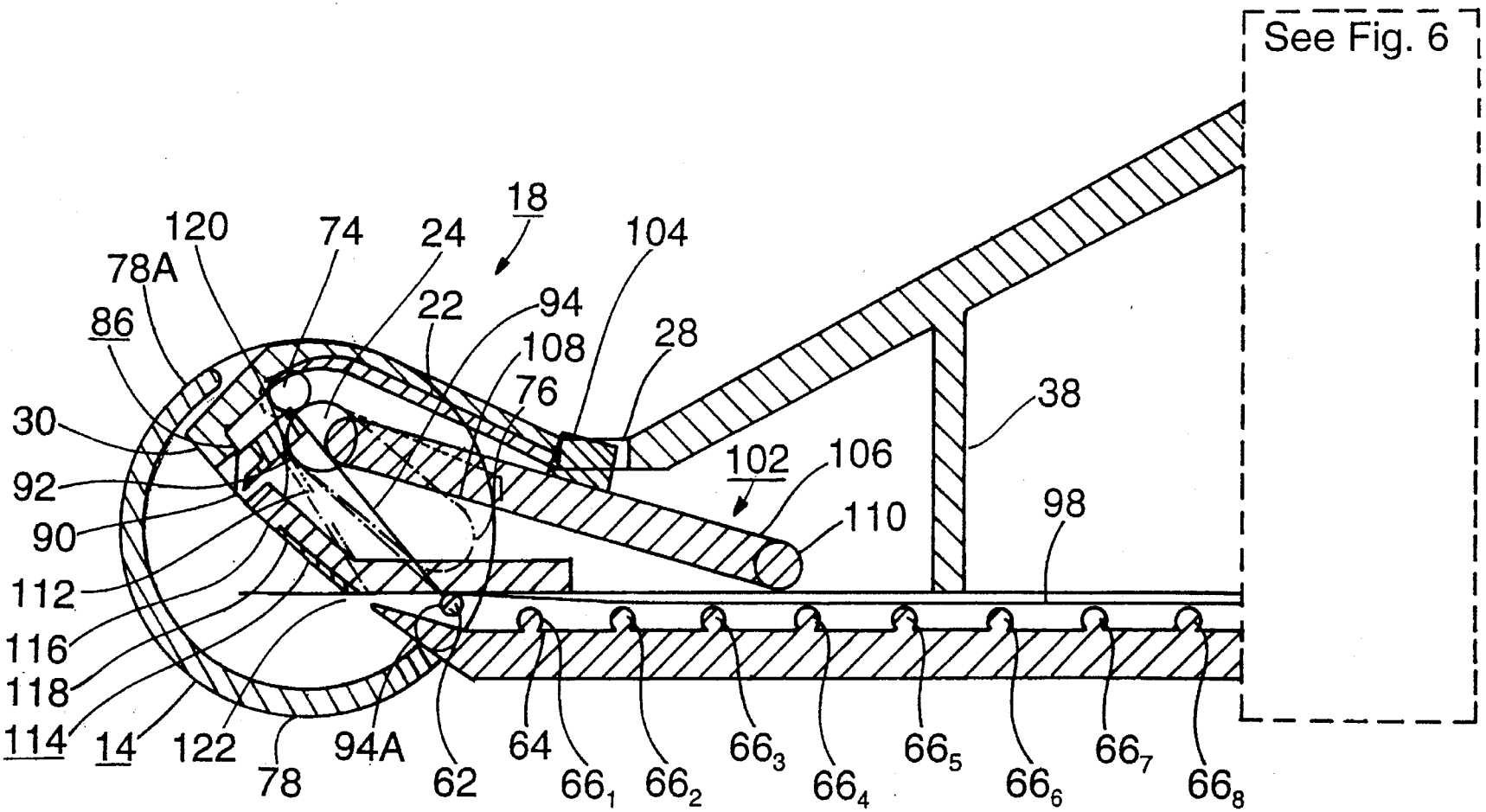
FIGS. 7, 8 and 9 illustrate further details of the applicator of FIGS. 1–6.

FIG. 7 illustrates an additional element of applicator 10 which is the actuator member 102. The actuator member 102 has a neck 104 that is dimensioned so as to be movable within the passageway 28. The actuator member 102 has first and second portions 106 and 108, laterally extending away from the neck 104 in opposite directions, with the first portion 106 having a device 110 (not shown but preferably having a structure similar to the prongs 94A and 96A), for mating with the actuator mating device 34 of the shell 12. The second portion 108 of the actuator member 102 is arranged to rest on the arm 94 of the cutting tool 86.

As seen in FIG. 7, the cutting tool 86 has a spring 112 inserted into its opening 92. The spring 112 supplies a force which tends to keep the cutting tool 86 in a vertical orientation and acts to return the cutting tool 86 to its orientation shown in FIG. 7 when the cutting tool 86 is disposed therefrom. It should be noticed that FIG. 7, as well as FIGS. 8 and 9, only partially illustrate the lower region of lever arm 94, especially near its prong 94A. This partial showing is accomplished so as to more clearly illustrate the opening where the leading edge of the tape 98 (to be described with reference to FIGS. 8 and 9) leaves or exits from the cartridge 44.

FIG. 7 further illustrates another element of applicator 10, that is, a contact member 114 having an upwardly raised portion 116. The raised portion 116 has first 118 and second 120 faces, with the first face 118 being arranged so as to be capable of coming into contact with the non-adhesive face of the leading edge of the tape being dispensed by the applicator 10. The first face 118 preferably comprises a resilient material. As will be further described hereinafter, the resilient material of the first face 118 allows the applicator 10 to be pressed down onto a surface of interest without any scarring thereof which is of particular importance, especially when using the applicator 10 in the wrapping of presents contained within fragile packages. The raised portion 116 is positioned in the first passageway 26 so as to be proximate to the cutting tool 86. As to be further described, the cutting tool 86 and the contact member 114 cooperatively operate to cut the tape 98 which is arranged to be fed out of the applicator 10 at the opening 122. The width of the opening 122 exceeds that of the tape 98.

As seen in FIG. 7, the partial cylindrical member 78 provides a barrier or enclosure for such an opening 122. The partial cylindrical member 78 has one end that has its middle section tapered and dimensioned so as to form a contoured end 78A that is insertable into the second passageway 28. As further seen in FIG. 7, the contoured end 78A is positioned proximate the leading edge 30 of the shell 12. Still further, as seen in FIG. 7, when the partial cylindrical member 78 provides an enclosure for opening 122, the pin 24 of the shell 12 is located in the upper corner (as viewed in FIG. 7) of the groove 76 of cover 14 and, also, the pin 74 of the cover 14 is at the upper corner (as viewed in FIG. 7) of the groove 22 of the shell 12. When these pins 24 and 74 are at the respective locations shown in FIG. 7, the tape 98 is not exposed to any contaminants. This non-exposure keeps the tape free from contaminants and becomes readily available to be applied to a surface of interest. The tape may be applied by the manipulation of the cover 14 acting as a control knob and which may be further described with reference to FIG. 8.

Figure 8:
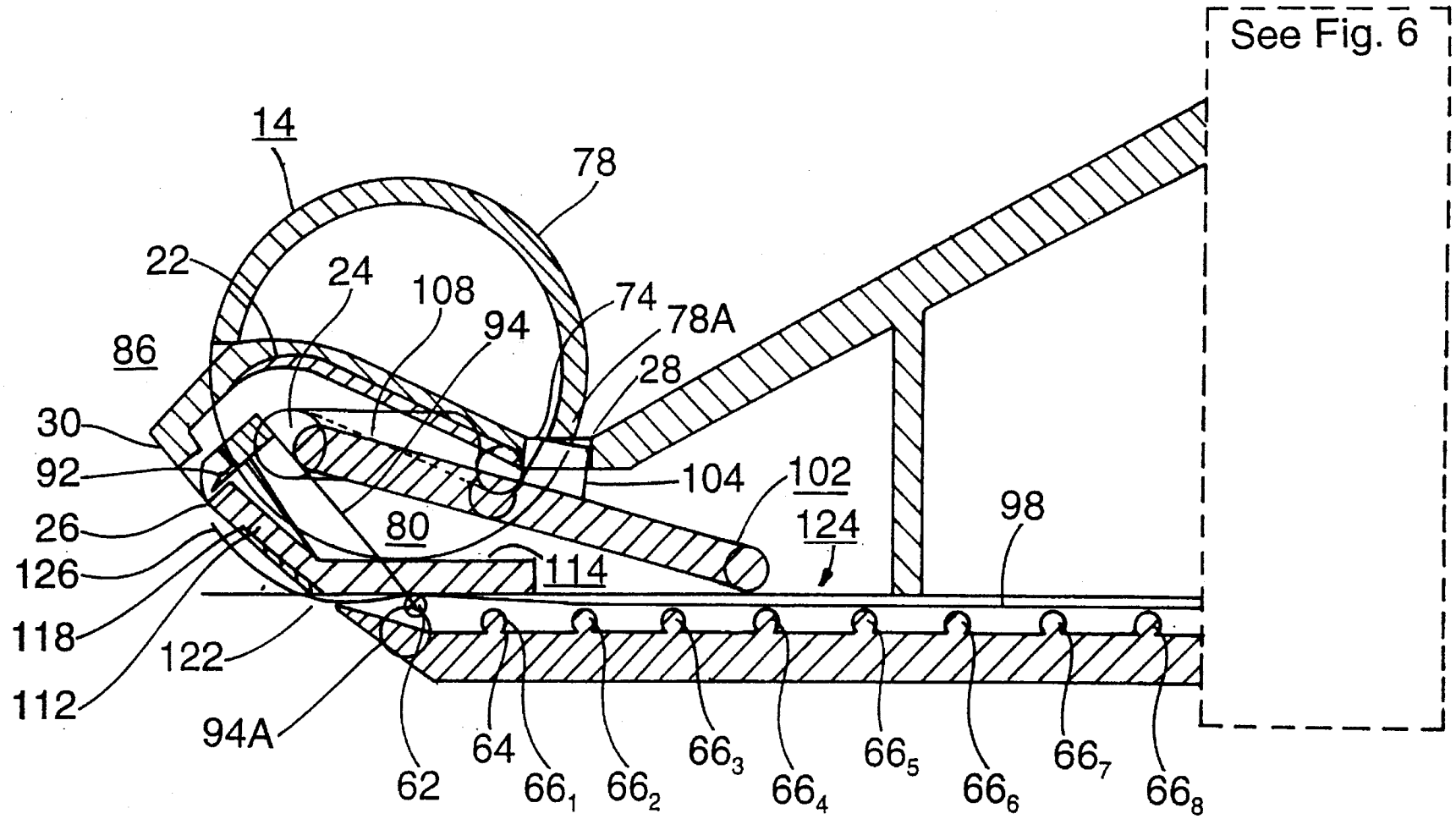

A comparison between FIGS. 8 and 7, reveals that the pin 24 is still located in the upper corner of the groove 76, but the upper corner of groove 76 has been rotated downward (as viewed in FIG. 8) by about 90 degrees, relative to its lower corner. Further, the pin 74 of FIG. 8 is now in the lower corner of the groove 22, shown in phantom, of the shell 12. In order to obtain such a reorientation of groove 76 and pin 74, the cover 14, in particular the partial cylindrical portion 78, need only be rotated in a counterclockwise direction and the curvature of the first and second grooves need only be selected so that the cover 14 is guided about the shell 12 to allow the contoured end 78A to be insertable into the second passageway 28. In this position, the cover 14 now may serve as a control knob that is used to move the cutting tool 86 in a manner so as to cut the tape 98. Such a movement may be further described with reference to FIG. 9.

Figure 9:
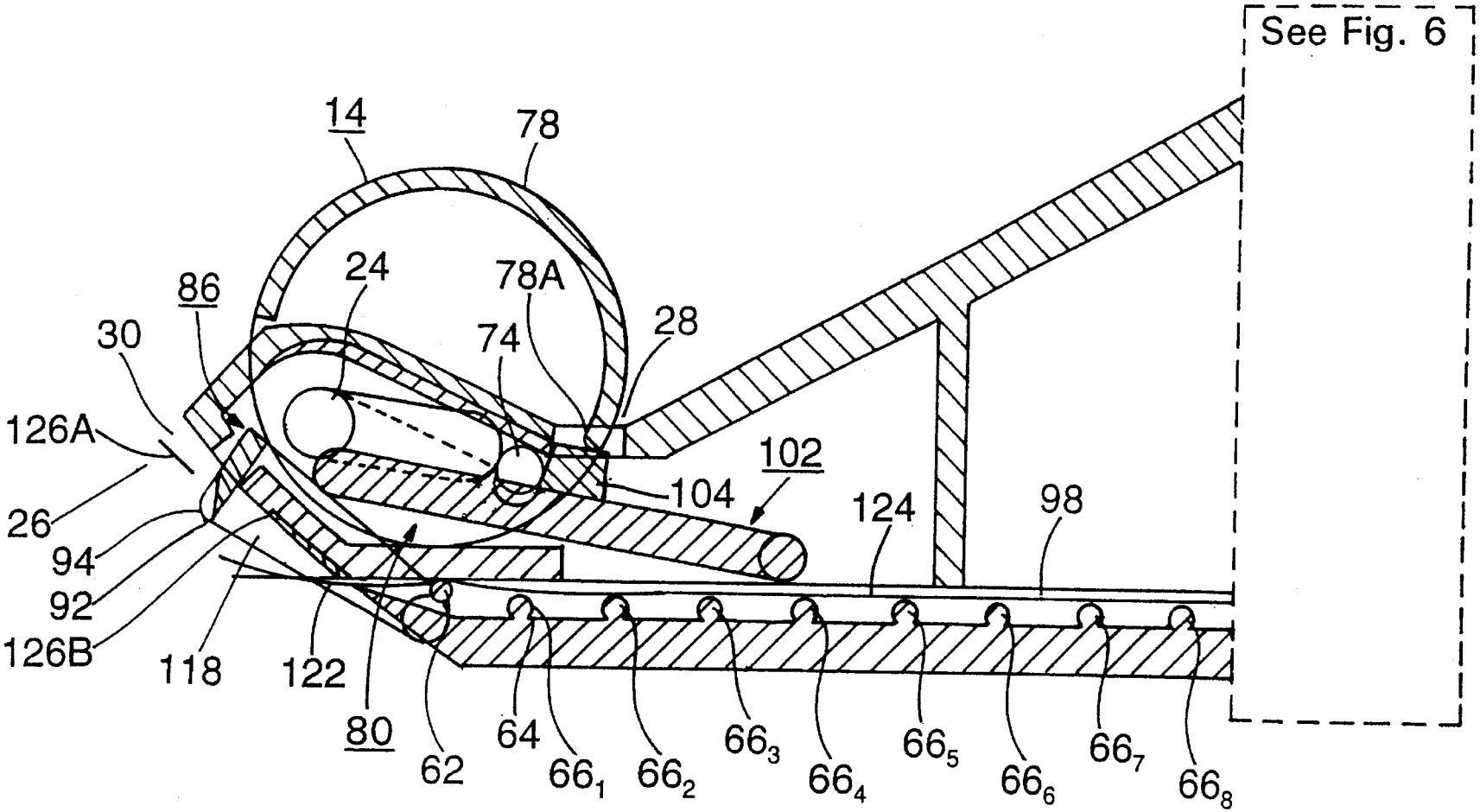

A comparison between FIGS. 9 and 8 reveals that the contoured end 78A of FIG. 9 is further inserted (relative to that shown in FIG. 8) into the passageway 28 which, in turn, causes the actuator 102 to have its second end 108 pressed down onto the lever arm 94 of the cutting tool 86 which, in turn, causes the cutting instrument 92 to exit from the first passageway 26 so that it may cut the tape 98 that is made available in the general region of the first face 118.

THE OPERATION OF THE APPLICATOR

The operation of the applicator 10 may be described with a general reference to FIGS. 7, 8 and 9, and a more specific reference to FIGS. 10 and 11, which are perspective views showing the use of the applicator 10 applying and cutting the applied tape 98. As generally seen in FIG. 8, the non-adhesive face of the tape 98 is positioned above the anti-grip bars $\mathbf{66}_1 \ldots \mathbf{66}_7$, and above the braking bar 62, with the adhesive face of the tape 98 facing the grip bars $\mathbf{66}_n$ and the breaking bar 62, so that the leading edge 126 is put into a position proximate the first 10 face 118 of the contact member 114. As seen in FIG. 9, after the cutting tool has been moved by the counterclockwise rotation of cover 14 so as to exit the passageway 26, the cutting tool, in particular, the cutting instrument 92 intercepts and severs the tape 98 causing the leading edge 126 to be separated into two pieces 126A and 126B, with piece 126A remaining attached to the surface of interest (to be described) and piece 126B remaining releasably attached to the first face 118. The application of the tape 98 to a surface of interest and the cutting thereat, may be further described with reference to FIGS. 10 and 11.

Both FIGS. 10 and 11 illustrate the applicator 10 as being used on a surface of interest 128 to dispense adhesive tape 98 thereon. Further, FIGS. 10 and 11 illustrate that the applicator 10 is controlled by one hand 16 of an operator having one finger contacting the cover 14 which serves as a control knob.

As seen in FIG. 10, and again with reference to FIG. 8, the applicator 10 is held by one hand so as to establish a "mark." More particularly, with reference to FIG. 8, the applicator 10 is manipulated so that the first face 118 firmly comes into contact with the leading edge 126 and further manipulation of applicator 10, in a downward direction, causes the tape 98 to be pressed down and adhere to the surface of interest 128. Further, as seen in FIG. 10, the applicator 10 is held at an inclination 132. This inclination 132 is preferably established by resting the palm 16A of the one hand 16 onto the surface of interest 128. After establishing such an inclination, the user need only move the applicator 10 from left to right, as shown by arrow 134, until she/he has dispensed the desired amount of tape 98 and has reached a location 136, shown in FIG. 11. The initial movement of the applicator 10 on the surface of interest 128 causes the non-skid protrusion $\mathbf{82}_N$ (see FIG. 4(A)) to catch on the surface 128 and to automatically initiate the counterclockwise rotation of the cover 14.

A comparison between FIGS. 11 and 10 reveals that the applicator 10 of FIG. 11 has been rotated in a counterclockwise direction, by about 40–45 degrees. Such rotation is allowed because the leading edge 30 (see FIG. 8) of the applicator 10 establishes a fixed position so as to allow rotation thereabout. Simultaneously during such rotation, the finger of the user rotates the cover 14 in a counterclockwise direction and which continued rotation, as described with reference to FIG. 9, causes the cutting instrument 92 to sever the tape 98. During such rotation and severing, it is preferred that the applicator 10 be held in such a manner so that tension exists in the tape 98. The tension contributes to the severing of the tape 98 by the cutting instrument 92.

As may be seen with reference to FIG. 9, after the leading edge of the tape 98 has been severed, any recoiling of the tape is prevented by the braking bar 62 which intercepts any backward movement of the tape 98 toward the roll 100.

It should now be appreciated that the practice of the present invention provides for an applicator that is easily manipulated by the single hand of a user so as to dispense adhesive tape onto a surface of interest and to only expose the tape to any environment that might contain contaminants during the dispensing thereof.

The applicator of the present invention can be disposed once the originally installed tape 98 is exhausted or, conversely, the tape 98 on a roll 100 can be conveniently reinstalled into the reservoir 44. More particularly, as previously discussed, the reservoir 44 may be easily and quickly removed from the shell 12 by means of the snap-tight fittings provided by their respective prongs.

It should now be appreciated that the practice of the present invention provides for an applicator that not only is easily manipulated, safeguards its tape against contaminants, but also allows for easy replacement of its associated tape.

While several preferred embodiments of the present invention have been disclosed, and modifications thereof suggested, it will be recognized by those skilled in the art that still other changes could be made to the above-identified embodiments of the invention without departing from the broader concepts thereof. It should be understood, therefore, that the invention is not limited to the particular embodiments disclosed, but is intended to cover the modifications which are within the scope and spirit of the present invention, as defined by the appended claims.

What is claimed is:

1. An applicator for dispensing tape, the tape having an adhesive on at least one face thereof, the applicator comprising:

(a) a shell having opposite sides, a first end and a second end, the first end including a first passageway and a second passageway;

(b) a cartridge received within the shell, the cartridge having a means for rotatably supporting a roll of the tape, wherein a leading edge of the tape extends outwardly from the roll;

(c) a partial cylindrical cover member having an open portion and a closed portion, the cover member connected to the first end of the shell for slidable movement thereabout along a predetermined path, wherein one end of the cover includes a contoured portion for being inserted into the second passageway;

(d) a cutting tool having a first portion with a leading edge serving as a cutting instrument and at least one lever arm, the first portion being movable within the first passageway;

(e) an actuator having a neck portion movable within the second passageway, the actuator having first and second portions extending away from the neck portion in opposite directions, wherein the second portion contacts the at least one lever arm; and (f) a contact member having an upwardly raised portion with first and second faces, the first face for contacting the leading edge of the tape, wherein the raised portion is positioned in the first passageway proximate the cutting tool.

2. The applicator according to claim 1, wherein said cutting tool is movable between a first position and a second position in response to movement of said cover member.

3. The applicator according to claim 1, wherein said first passageway has a lip on a leading edge thereof.

4. The applicator according to claim 1, wherein said closed portion of said cover member has a plurality of members protruding from an upper surface thereof for allowing a user to grip and move the cover member.

5. The applicator according to claim 4, wherein at least one of said members on the cover member has a non-skid surface.

6. The applicator according to claim 1, further comprising a spring member connected to said cutting tool for maintaining said cutting tool in a vertical orientation.

7. The applicator according to claim 1, wherein said cartridge has a rail and a tray and a plurality of bar members mounted thereon over which said leading edge of said tape passes for preventing the tape from sticking to an interior surface of the cartridge.

8. The applicator according to claim 7, wherein said cartridge has an output stage having a braking bar member over which said leading edge of said tape passes for preventing the tape from recoiling back toward the roll.

9. The applicator according to claim 1, wherein said means for rotatably supporting roll of the tape has a protruding member that comes into contact with a central region of said roll.

10. The applicator according to claim 1, wherein said contoured portion of the cover contacts said neck of said actuator which, in turn, has its second portion contacting said lever arm of said cutting tool, thereby causing said cutting tool to exit said first passageway and intercept and cut the tape proximate thereto.

11. The applicator according to claim 1 wherein the second end of the shell is contoured to facilitate gripping thereof.

12. The applicator according to claim 1 further comprising means for slidably moving the cover member about the first end of the shell.

* * * * *